US007260347B2

(12) United States Patent
Tamaki et al.

(10) Patent No.: US 7,260,347 B2
(45) Date of Patent: Aug. 21, 2007

(54) IMAGE FORMING APPARATUS

(75) Inventors: Masayuki Tamaki, Toride (JP); Yuji Bessho, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 11/250,506

(22) Filed: Oct. 17, 2005

(65) Prior Publication Data

US 2006/0104674 A1 May 18, 2006

(30) Foreign Application Priority Data

Nov. 15, 2004 (JP) ..... 2004-331265

(51) Int. Cl.
*G03G 15/09* (2006.01)
*G03G 15/06* (2006.01)

(52) U.S. Cl. ..... 399/269; 399/55; 399/270; 399/276

(58) Field of Classification Search ..... 399/55, 399/149, 269, 270–277
See application file for complete search history.

(56) References Cited

U.S. PATENT DOCUMENTS 4,804,995 A * 2/1989 Osawa et al. ..... 399/273
6,449,448 B2 9/2002 Bessho et al. ..... 399/149
6,650,858 B2 11/2003 Bessho ..... 399/267
6,697,596 B2 2/2004 Bessho et al. ..... 399/302
6,941,099 B2 * 9/2005 Iwata ..... 399/269
6,975,825 B2 * 12/2005 Sakamaki et al. ..... 399/269

FOREIGN PATENT DOCUMENTS

JP 10-312110 11/1998
JP 2003-173086 6/2003

* cited by examiner

*Primary Examiner*—Hoang Ngo
(74) *Attorney, Agent, or Firm*—Fitzpatrick, Cella, Harper & Scinto

(57) ABSTRACT

A developing apparatus having: a first developer carrying member close to a developer regulating member for regulating an amount of developer; a second developer carrying member to which the developer is delivered from the first developer carrying member; and a mode for removing the toner on the surface of the second developer carrying member, in which mode, in a non-image-formation period, no toner transfer operation from the first developer carrying member to an image bearing member is substantially performed, but a toner transfer operation from the second developer carrying member to the image bearing member is performed.

13 Claims, 10 Drawing Sheets

IMAGE FORMING APPARATUS

BACKGROUND OF THE INVENTION

1. Field of the Invention

The present invention relates to an image forming apparatus, such as a copier or a laser beam printer, which employs an electrophotographic printing method or an electrostatic recording method and includes a developing apparatus for visualizing a latent image formed on an image bearing member by adhering a developer thereto.

2. Related Background Art

Heretofore, in an image forming apparatus such as a copier using an electrophotographic printing method or an electrostatic recording method, an electrostatic latent image formed on an image bearing member such as a photosensitive drum is visualized by adhering a developer thereonto. Among developing apparatuses for use in such development, an example of one using a two-component developer containing a toner and a carrier is shown in FIG. 11.

In this example, in a developing apparatus 1, a first developing sleeve 8 as a first developer carrying member is disposed so as to be rotatable in an arrow direction shown in FIG. 11 in a developer container 2 for housing a two-component developer that contains a non-magnetic toner and a magnetic carrier as a developer T. Further, a developer regulating blade 9 for regulating the magnetic brush of the developer carried on the first developing sleeve 8 is disposed.

Further, a second developing sleeve 11 as a second developer carrying member is disposed so as to be rotatable in the same direction as a rotation direction of the first developing sleeve 8 in a region under the first developing sleeve 8, which is opposed to the first developing sleeve 8.

In addition, the developer container 2 is vertically partitioned by a partition wall 7 into an upper developing chamber 3 and a lower agitating chamber 4, in which developer feed screws 5 and 6 are disposed, respectively. The developer T circulates in the developing chamber 3 and the agitating chamber 4 by the above-described screws 5 and 6.

Note that the first developing sleeve 8 is a cylindrical member made of a non-magnetic material, in the inside of which a magnet roller 8*a* as first magnetic field generating means is provided in a non-rotating state. The magnet roller 8*a* includes a developing pole S2 and magnetic poles S1, N1, N2, and N3 which feed the developer. Among them, the first magnetic pole N3 and the second magnetic pole N1 which have the same polarity are adjacent to each other to form a repulsive magnetic field therebetween, and a barrier is formed against the developer.

Further, a second developing sleeve 11 is made of a non-magnetic material, in the inside of which a magnet roller 11*a* as second magnetic field generating means is provided in a non-rotating state in a similar way to the first developing sleeve 8. The magnet roller 11*a* includes three magnetic poles S3, S4, and N4. Among them, the third magnetic pole S3 and the fourth magnetic pole S4 which have the same polarity are adjacent to each other to form a repulsive magnetic field therebetween, and a barrier is formed against the developer.

The S2 pole of the magnet roller 8*a* and the N4 pole of the magnet roller 11*a* are the developing poles. The developer which stands like the ears by the S2 pole and the N4 pole develops a latent image formed on a photosensitive drum 10 by applying a developing bias as a superimposed voltage of a DC voltage and an AC voltage to the first developing sleeve 8 and the second developing sleeve 11.

In such two-component development as described above, at the time of developing a white ground portion, the toner in the developer at a developing nip portion is thrust in a direction toward the first developing sleeve 8 and the second developing sleeve 11 by an electric field formed of a voltage on-the photosensitive drum 10 and the developing bias.

Specifically, the toner is developed on the first developing sleeve 8 and the second developing sleeve 11 after developing the white ground portion. In other words, the toner is attached onto the first developing sleeve. Sand the second developing sleeve 11 and the surfaces of the first developing sleeve 8 and the second developing sleeve 11 turn into a contaminated state by the toner.

When a high-density portion is developed in the state where the first developing sleeve 8 and the second developing sleeve 11 are in the contaminated state by the toner, the toner that has contaminated the first developing sleeve 8 and the second developing sleeve 11 is developed on the photosensitive drum 10. Accordingly, there has sometimes occurred a malfunction that a density is increased only in the contaminated portion with regard to the electrostatic latent image with a uniform electric field on the photosensitive drum 10, that is, a phenomenon (so-called ghost) of dragging an image of the immediately previous rotation of the first developing sleeve 8 and the second developing sleeve 11.

Further, it is conceivable that the developer attached onto the first developing sleeve 8 and the second developing sleeve 11 for a long period of time rubs against other developers and members and is fused onto the first developing sleeve 8 and the second developing sleeve 11 owing to frictional heat.

When the toner is fused onto the surfaces of the first developing sleeve 8 and the second developing sleeve 11, a feed amount of the developer to the developing regions of the first developing sleeve 8 and the second developing sleeve 11 is lowered to thus lower an image density, and high-resistance layers made of fused matter on the surfaces of the first developing sleeve 8 and the second developing sleeve 11 are formed. Accordingly, even if the developing bias is applied to the developing region between the first developing sleeve 8 and the photosensitive drum 10 and the developing region between the second developing sleeve 11 and the photosensitive drum 10 at the time of the development, desired electric fields are not formed. As a result, a sufficient development effect brought by the developing bias has not been obtained. Therefore, sometimes the density decreases, and an image failure such as blank areas sometimes occurs.

The toner contamination mentioned above is more prone to occur in the second developing sleeve 11 than in the first developing sleeve 8. The reason is as follows. As for the developer on the first developing sleeve 8, an amount thereof passing the developer regulating blade 9 is regulated by the developer regulating blade 9, and the developer tends to accumulate between the S1 pole and N1 pole of the magnet roller 8*a*. Therefore, the toner contamination attached onto the first developing sleeve 8 is scraped off easily by being rubbed with the accumulated developer. On the other hand, the second developing sleeve 11 which does not include the developer regulating blade 9 does not have the accumulated developer, and accordingly, becomes prone to be contaminated by the toner more significantly.

As measures against the problems as described above, it is necessary to always keep the surface of the second developing sleeve 11 in a state where there is no toner contamination on the developing sleeve 11 by cleaning the toner adhering onto the second developing sleeve 11. With regard to this, the following proposals have been made heretofore.

There have been proposed: a construction, in which a Mylar tape, an elastic blade, or a fur brush is attached as a member for scraping off a toner adhering onto a developing sleeve to scrape off the toner on the developing sleeve in a contact manner; and a construction, in which a conductive roller is provided in a non-contact manner with respect to a developing sleeve, a voltage is applied between the conductive roller and the developing sleeve, and a toner adhering onto the developing sleeve is made to fly toward the conductive roller side to scrape off the toner on the developing sleeve (for example, refer to JP 10-312110 A and JP 2003-173086 A).

However, in the above-described constructions, the following problem occurs.

Specifically, the member for scraping off the toner adhering onto the developing sleeve is newly provided, and accordingly, requirements for space saving and cost reduction of the image forming apparatus using the electrophotographic printing method in recent years cannot be satisfied. It has not been preferable to provide such a scraping member in terms of design.

SUMMARY OF THE INVENTION

It is an object of the present invention to provide an image forming apparatus which always keeps a surface of a developer carrying member that is not close to a developer regulating member in a state where there is no toner contamination by cleaning a toner adhering onto the developer carrying member without particularly providing a member for cleaning the toner contamination adhering onto the developer carrying member, thereby making it possible to obtain a developer image in which a developing density is maintained constant.

To attain the object described above, there is provided an image forming apparatus, including: an image bearing member on which an electrostatic image is formed; a first developer carrying member and a second developer carrying member for carrying a developer for developing the electrostatic image, the developer containing a toner and a magnetic carrier, and for feeding the developer to a developing region opposed to the image bearing member; and a developer regulating member for regulating the developer on the first developer carrying member, in which, the developer is delivered from the first developer carrying member to the second developer carrying member. The image forming apparatus is provided with a mode for removing the toner on a surface of the second developer carrying member, in which, in a non-image-formation period, no toner transfer operation from the first developer carrying member to the image bearing member is substantially performed while a toner transfer operation from the second developer carrying member to the image bearing member is performed.

In another preferred aspect of the present invention, an image forming apparatus includes: an image bearing member on which an electrostatic image is formed; a first developer carrying member and a second developer carrying member for carrying a developer for developing the electrostatic image, the developer containing a toner and a magnetic carrier, and for feeding the developer to a developing region opposed to the image bearing member; and a developer regulating member for regulating the developer on the first developer carrying member, in which, the developer is delivered from the first developer carrying member to the second developer carrying member. The image forming apparatus is provided with a mode for removing the toner on a surface of the second developer carrying member by providing, in a non-image-formation period, a voltage difference between the first developer carrying member and second developer carrying member, and by transferring the toner on the surface of the second developer carrying member is transferred to the first developer carrying member.

DESCRIPTION OF THE PREFERRED EMBODIMENTS

An image forming apparatus according to the present invention is described below in detail with reference to the drawings. In this embodiment, description is made of the case where a latent image has a negative polarity, a toner is also negatively charged, and the latent image is reversely developed.

Note that, though a developing apparatus, which forms a feature of the present invention, is used in the image forming apparatus as described below, the developing apparatus is not necessarily limited to this mode.

First Embodiment

Figure 1:
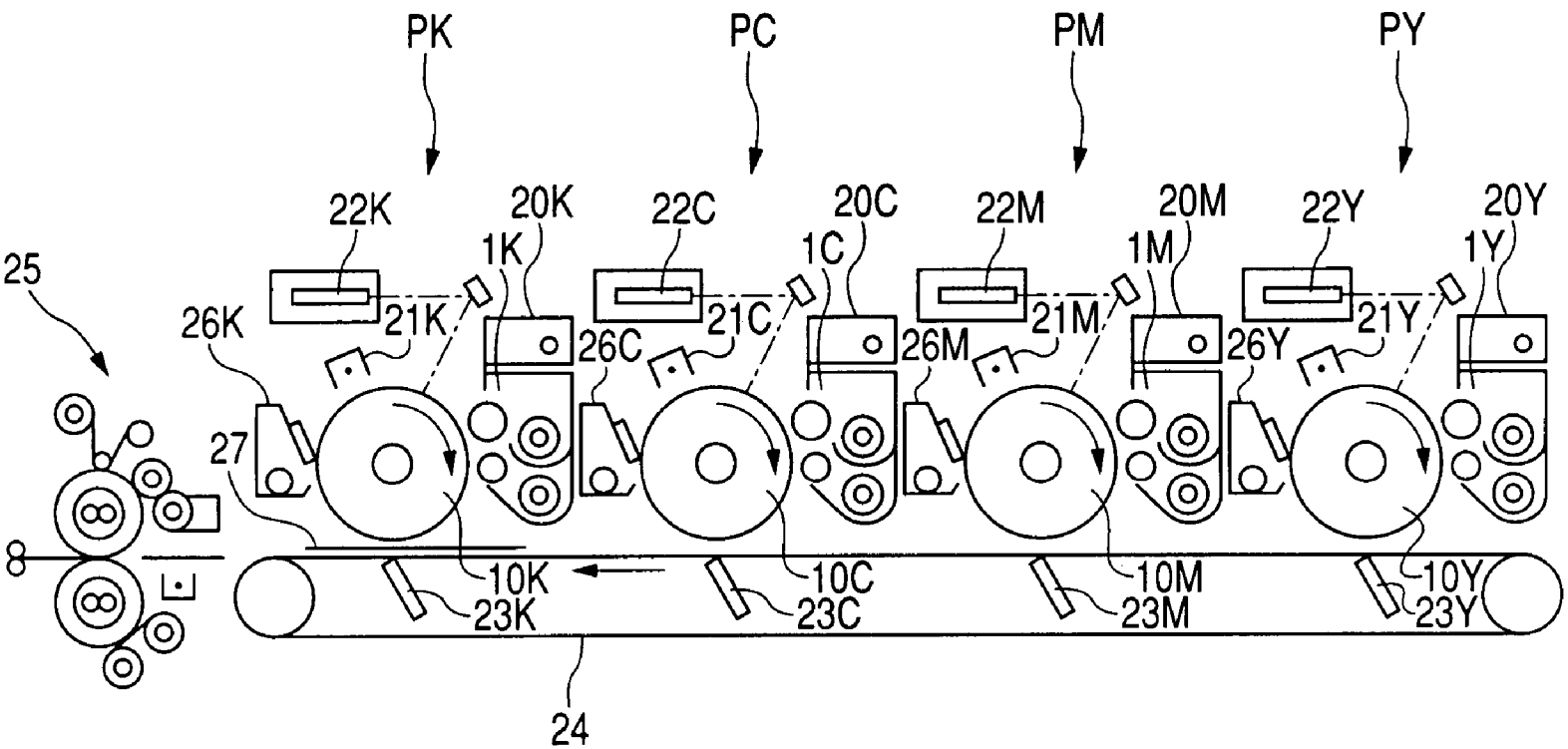
FIG. 1 is a cross-sectional view showing a schematic construction of an embodiment of an image forming apparatus according to the present invention.
Figure 2:
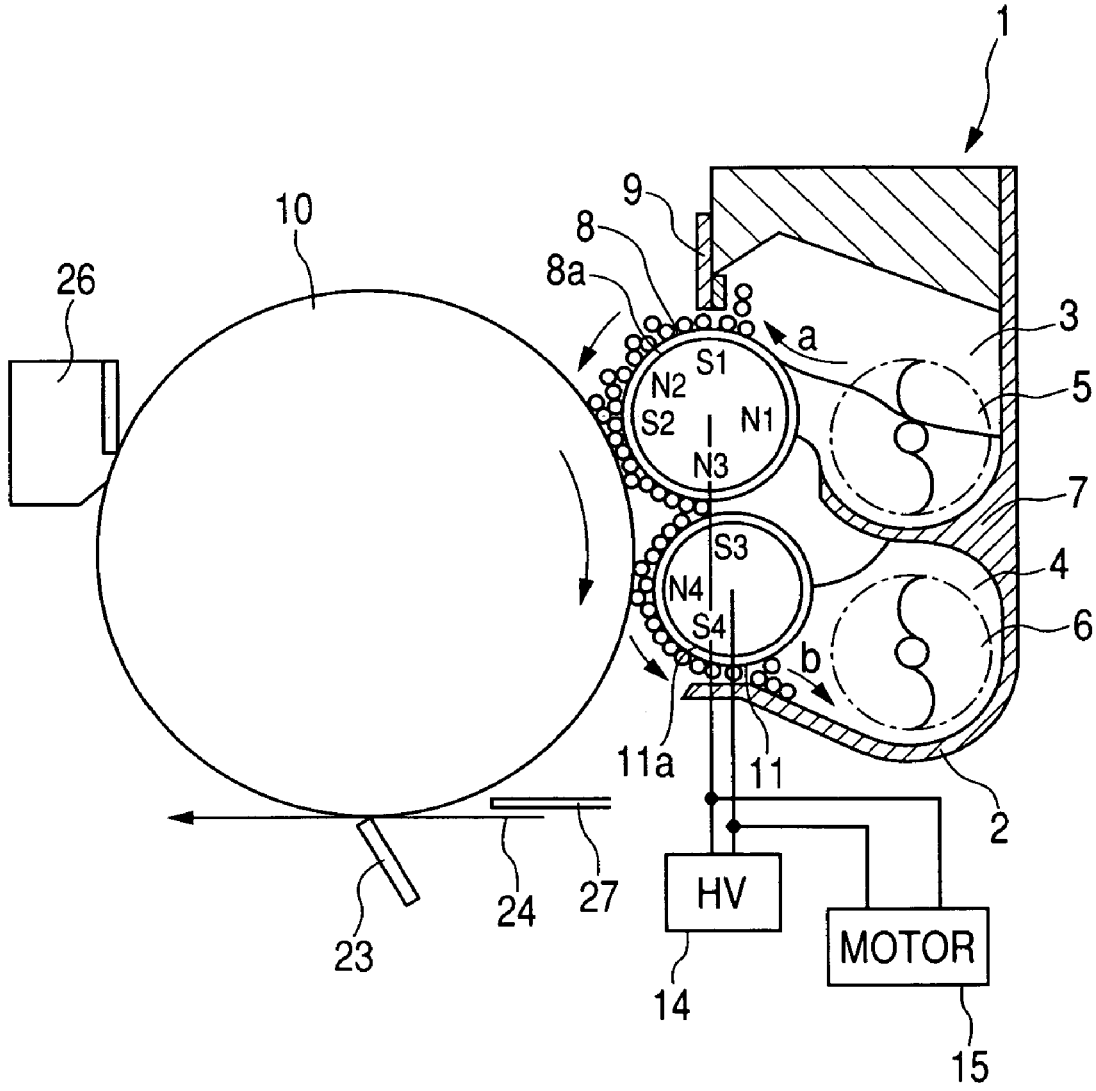
FIG. 2 is a cross-sectional view showing a schematic construction showing an embodiment of a developing apparatus for use in the image forming apparatus according to the present invention.

FIG. 1 shows a schematic construction of an embodiment of the image forming apparatus according to the present invention. FIG. 2 shows the developing apparatus for use in the image forming apparatus in more detail. In this embodiment, it is assumed that the image forming apparatus is a full-color image forming apparatus of an electrophotographic printing method.

As shown in FIGS. 1 and 2, in this embodiment, the full-color image forming apparatus includes a plurality of, four in this embodiment, image forming portions (stations) P (PY, PM, PC, PK), that is, a yellow (Y) image forming station PY, a magenta (M) image forming-station PM, a cyan (C) image forming station PC, and a black (K) image forming station PK.

The respective image forming stations P (PY, PM, PC, PK) have similar constructions, and in a full-color image, form images of yellow (Y), magenta (M), cyan (C), and black (K), respectively.

In the following description, it is assumed that, for example, a developing apparatus 1 commonly represents a developing apparatus 1Y, a developing apparatus 1M, a developing apparatus 1C, and a developing apparatus 1K in the respective image forming stations P (PY, PM, PC, PK) shown in FIG. 1. This can also be applied to other apparatuses and members.

First, an operation of the entire image forming apparatus is described with reference to FIG. 1.

In the respective image forming stations P (PY, PM, PC, PK), drum-shaped electrophotographic photosensitive members as image bearing members with a diameter of 40 to 150 mm, that is, photosensitive drums 10 (10Y, 10M, 10C, 10K) are provided so as to be freely rotatable. The photosensitive drums 10 (10Y, 10M, 10C, 10K) are uniformly charged by primary chargers 21. (21Y, 21M, 21C, 21K), and are exposed with light modulated according to information signals by exposure apparatuses 22 (22Y, 22M, 22C, 22K) including light-emitting elements such as, for example, lasers, thereby forming electrostatic latent images (electrostatic images).

The electrostatic latent images on the photosensitive drums 10 are visualized as developer images (toner images) by the developing apparatuses 1 (1Y, 1M, 1C, 1K) in a process as described later.

Next, the toner images on the above-described photosensitive drums 10 are transferred by transfer chargers 23 (23Y, 23M, 23C, 23K) as transferring means to transfer paper 27 as a recording material conveyed by a transfer paper conveyor sheet 24, and further, are fixed by a fixing apparatus 25. In such a way, a permanent image is obtained.

Further, a transfer residual toner on the photosensitive drums 10 is removed by cleaning apparatuses 26 (26Y, 26M, 26C, 26K).

Further, here, the toner consumed by forming the image is replenished from toner supply tanks.20 (20Y, 20M, 20C, 20K) provided on the developing apparatuses 1 (1Y, 1M, 1C, 1K).

In this embodiment, a method of directly transferring the image from the photosensitive drums 10 (10Y, 10M, 10C, 10K) to the transfer paper 27 as the recording material conveyed by the transfer paper conveyor sheet 24 has been adopted. However, the present invention can also be applied to an image forming apparatus with a construction in which an intermediate transfer member is provided in place of the transfer paper conveyor sheet 24, the toner images of the respective colors are primarily transferred from the photosensitive drums 10 (10Y, 10M, 10C, 10K) of the respective colors to the intermediate transfer member, and a composite toner image of the respective colors is then secondarily transferred to the transfer paper 27 collectively.

Next, an operation of each developing apparatus 1 is described with reference to FIG. 2.

In a developer container 2 for housing a two-component developer that contains a non-magnetic toner and a magnetic carrier as a developer T, the developing apparatus 1 of this embodiment includes a first developing sleeve 8 as a first developer carrying member with a diameter of 15 mm or more, and a developer regulating blade 9 as a developer regulating member for regulating the magnetic brush of the developer carried on the first developing sleeve 8. Further, a second developing sleeve 11 as a second developer carrying member with a diameter of 15 mm or more is disposed in a region under the first developing sleeve 8, which is opposed to the first developing sleeve 8.

In addition, the developer container 2 is vertically partitioned by a partition wall 7 into an upper developing chamber 3 and a lower agitating chamber 4, in which developer feed screws 5 and 6 are disposed, respectively. The first feed screw 5 is disposed substantially parallel along an axial direction of the first developing sleeve 8 in a bottom portion of the developing chamber 3. The first feed screw 5 rotates to feed the developer in the developing chamber 3 in one direction along the axial direction. Meanwhile, the second feed screw 6 is disposed substantially parallel to the first feed screw 51 in a bottom portion of the agitating chamber 4, and feeds the developer in the agitating chamber 4 in a direction reverse to the feeding direction of the first feed screw 5. In such a way, the developer T circulates in the developing chamber 3 and the agitating chamber 4 by being fed by the rotations of the above-described feed screws 5 and 6.

Further, a position corresponding to a developing region of the developer container 2, which is opposed to the photosensitive drum 10, is opened. The first and second developing sleeves 8 and 11 are arranged in this opening portion so as to be rotatable and to be partially exposed to the photosensitive drum 10 provided in the image forming apparatus. The first and second developing sleeves 8 and 11 rotate in a direction passing through the developing region as the region opposed to the photosensitive drum 10 from upward to downward in the vertical direction. Therefore, the first and second developing sleeves 8 and 11 rotate in such a direction that the developer is supplied from the upper developing chamber 3 and the developer after the development is returned to the lower agitating chamber 4.

Note that the first developing sleeve 8 is a cylindrical member made of a non-magnetic material, in the inside of which, a magnet roller 8*a* as a first magnetic field generating means is provided in a non-rotating state. The magnet roller 8*a* includes a developing pole S2, and magnetic poles S1, N1, N2, and N3 which feed the developer. Among them, the first magnetic pole N3 and the second magnetic pole N1 are adjacent to each other to form a repulsive magnetic field therebetween, and a barrier is formed against the developer.

The developer regulating blade 9 is made of a non-magnetic material such as aluminum, and is disposed upstream of the photosensitive drum 10 in the rotation direction of the first developing sleeve 8. Both of the non-magnetic toner and magnetic carrier of the developer T pass between the tip end of the developer regulating blade 9 and the first developing sleeve 8, and are sent to the developing region.

Note that, by adjusting an interval between the developer regulating blade 9 and a surface of the first developing sleeve 8, the amount of developer magnetic brushes carried on the first developing sleeve 8 is regulated, and the amount of the developer T fed to the developing region is adjusted.

Further, the second developing sleeve 11 is made of a non-magnetic material, in the inside of which, a magnet roller 11*a* as a second magnetic field generating means is provided in a non-rotating state in a way similar to the first developing sleeve 8. The magnet roller 11*a* includes three magnetic poles S3, S4, and N4. Among them, the third magnetic pole S3 and the fourth magnetic pole S4, which have the same polarity, are adjacent to each other to form a repulsive magnetic field therebetween, and a barrier is formed against the developer. Between the magnetic poles S3 and S4 which form the repulsive magnetic field, the third magnetic pole S3 that is downstream in the rotation direction of the developing sleeve 11 is opposed to the first magnetic pole N3 of the magnet 8*a* included in the first developing sleeve 8 in the vicinity of a position where both of the first and second developing sleeves 8 and 11 are the closest to each other.

The first feed screw 5 is disposed substantially parallel along the axial direction (developing width direction) of the first developing sleeve 8 in the bottom portion of the developing chamber 3. In this embodiment, the first feed screw 5 is constructed into a screw structure in which a blade member made of a non-magnetic material is provided in a spiral shape about a rotation shaft made of a ferromagnet. The first feed screw 5 rotates to feed the developer T in the developing chamber 3 in the bottom portion of the developing chamber 3 along the axial direction of the first developing sleeve 8.

Moreover, in a way similar to the first feed screw 5, the second feed screw 6 is also constructed into a screw structure in which a blade member reverse in direction to that of the first feed screw 5 is provided in a spiral shape about the rotation shaft. The second feed screw 6 rotates in the same direction as that of the first feed screw 5 to feed the developer T in the agitating chamber 4 in the direction reverse to that of the first feed screw 5.

The developer T circulates between the developing chamber 3 and the agitating chamber 4 by the rotations of the first and second feed screws 5 and 6 as described above. In the developing apparatus 1 of this embodiment, the developing chamber 3 and the agitating chamber 4 are arranged above and below in the vertical direction, the developer T from the developing chamber 3 to the agitating chamber 4 moves from upward to downward, and the developer T from the agitating chamber 4 to the developing chamber 3 moves from downward to upward. In particular, in the direction from the agitating chamber 4 to the developing chamber 3, the developer is discharged in such a manner that the developer is pushed upwards by pressure of the developer T that has collected in a corner of the agitating chamber 4.

Figure 3:
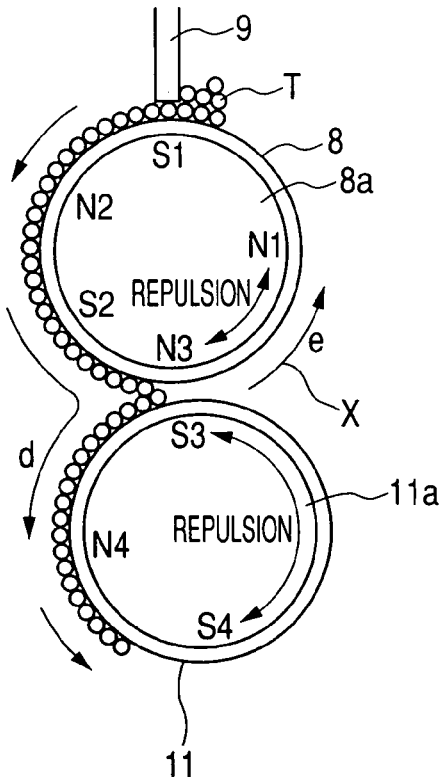
FIG. 3 is an enlarged cross-sectional view showing constructions of a first developer carrying member and a second developer carrying member in the developing apparatus of FIG. 2.

A flow of the developer T is described by using an enlarged view (FIG. 3) of the vicinity of the first developing sleeve 8 and the second developing sleeve 11.

The developer T is regulated in layer thickness by the developer regulating blade 9 disposed opposite to the vicinity of the S1 pole of the first developing sleeve 8 in a non-contact manner therewith, and a thin layer of the developer T is formed on the first developing sleeve 8. Then, the developer T that has been fed on the first developing sleeve 8 and has passed through the developing region reaches a position of the first magnetic pole N3 of the magnet 8*a*. The developer T cannot slip through the closest position which is an opposed position of both of the first and second developing sleeves 8 and 11 or cannot pass through as indicated by the arrow "e" owing to a repulsive magnetic field formed between the first magnetic pole N3 and the downstream second magnetic pole N1. Specifically, the developer T cannot be taken along the first developing sleeve 8, and as indicated by the arrow "d", moves to the second developing sleeve 11 in accordance with a magnetic flux extended in a direction from the N3 pole of the first developing sleeve 8 to the third magnetic pole S3 of the magnet 11*a* of the second developing sleeve 11. Then, the developer T is blocked at the S4 pole as the fourth magnetic pole by a repulsive magnetic field formed between the fourth magnetic pole S4 and the third magnetic pole S3, and is captured into the feed screw 6 in the agitating chamber 4.

In this embodiment, voltages to be applied to the first and second developing sleeves 8 and 11 are supplied power commonly from a high-voltage (HV) power supply 14, and the first and second developing sleeves 8 and 11 are driven commonly by a drive source (motor) 15. That is, the first and second developing sleeves 8 and 11 are driven in the same way by the same developing bias.

In order to improve developing efficiency (that is, a giving rate of the toner to the latent image formed on the photosensitive drum 10) in the first developing sleeve 8 and the second developing sleeve 11, the developing bias obtained by superimposing a direct-current voltage and an alternating-current voltage on each other is applied to the first and second developing sleeves 8 and 11 from the HV power supply 14. It is as mentioned above that, by this bias, the toner in the developer is thrust against the first and second developing sleeves 8 and 11 at the time of forming an image on a white ground portion, resulting in an image failure such as a ghost.

After being developed by the developing apparatus 1, the electrostatic latent image of the photosensitive drum 10 is transferred by the transfer charger 23. The transfer residual toner on the surface of the photosensitive drum 10 is cleaned by the cleaning apparatus 26.

Further, the toner contamination mentioned above is more prone to occur in the second developing sleeve 11 than in the first developing sleeve 8. The reason is as follows. As for the developer T on the first developing sleeve 8, an amount thereof passing through the developer regulating blade 9 is regulated by the developer regulating blade 9, and the developer T tends to collect between the SI pole and N1 pole of the magnet roller 8*a*. Therefore, the toner contamination attached onto the first developing sleeve 8 is scraped off easily owing to rubbing against the collected developer. Meanwhile, the second developing sleeve 11 which does not include the developer regulating blade does not have the collected developer, and accordingly, becomes prone to be contaminated by the toner more significantly.

Further, it is known that the amount of toner contamination of the second developing sleeve 11 is increased by using, as a member of the photosensitive drum 10, a high dielectric such as amorphous silicon and thin-film OPC with a dielectric constant of 8 or more. This is because many image charges are induced to the photosensitive drum 10 and the second developing sleeve 11 by using a high-electrostatic capacitor, and a large amount of toner is attracted to the surfaces of the photosensitive drum 10 and the second developing sleeve 11.

Figure 4:
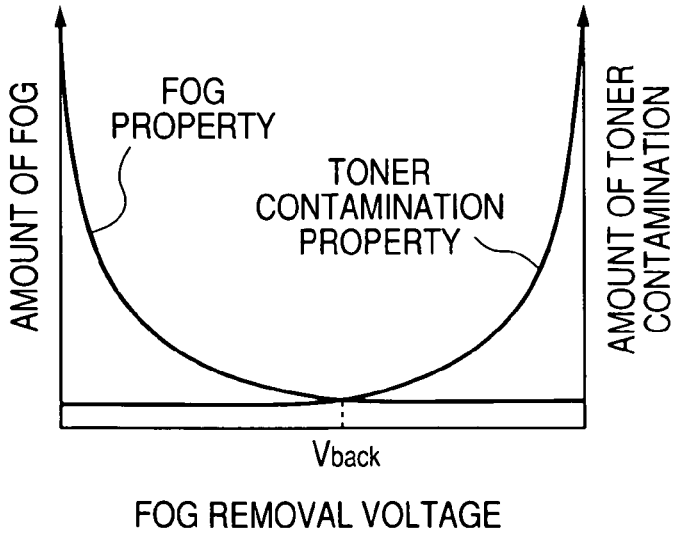
FIG. 4 is a graph for explaining relationships of an amount of fog and an amount of toner contamination with respect to a fog removal voltage.

FIG. 4 shows relationships of the amount of toner contamination (amount of fog) in a non-image portion of the electrostatic latent image on the photosensitive drum 10 and of the amount of toner contamination on the surface of the sleeve 11 with respect to a fog removal voltage.

Here, the fog removal voltage is a voltage difference between a dark portion voltage Vd (voltage of non-image portion) of the photosensitive drum 10 and the direct-current voltage Vdc applied to the second developing sleeve 11. The fog removal voltage refers to a voltage that gives power to the toner on the photosensitive drum 10 in a direction of being returned to the developing sleeve 11. When the amount of fog is increased, the toner will exist in the non-image portion, and an image is formed, in which the white ground portion of the paper is contaminated. In addition, when the amount of toner contamination is increased, the image failure such as a ghost occurs as mentioned above.

From FIG. 4, a relationship between the amount of fog and the amount of toner contamination is a symmetrical relationship, and the optimum fog removal voltage (Vback) that minimizes the values of the amount of fog and the amount of toner contamination exists. However, the amount of fog and the amount of toner contamination are in the symmetrical relationship as described above, and accordingly, occurrences of the fog and the toner contamination cannot be completely eliminated at the same time.

Figure 5:
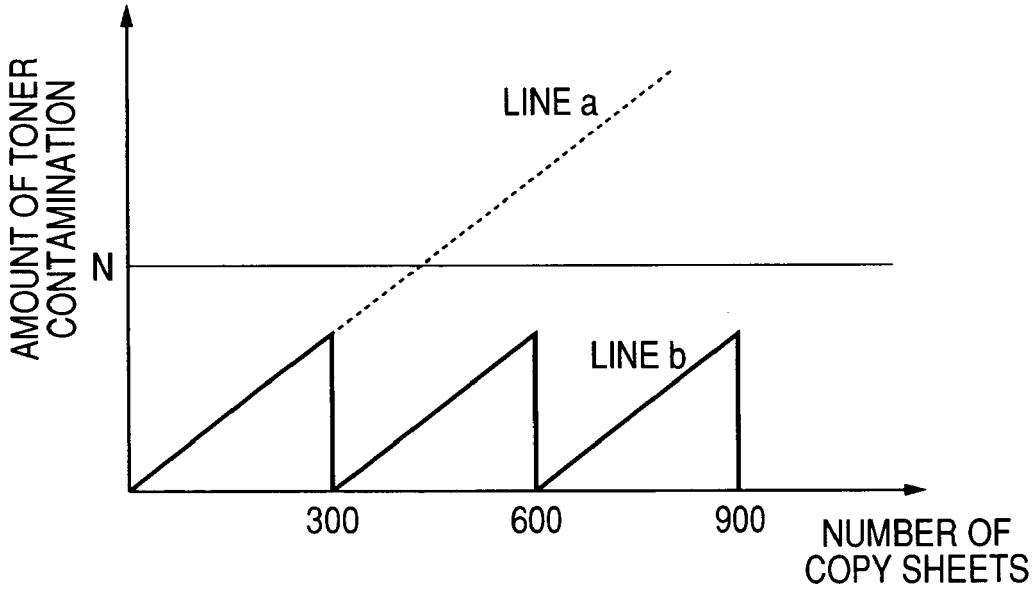
FIG. 5 is a graph for explaining a relationship between the amount of toner contamination on a surface of the second developer carrying member and the number of copy sheets in the case of performing a mode for removing a toner and in the case of not performing the mode for removing a toner.

Further, FIG. 5 shows the relationship between the amount of toner contamination on the surface of the second developing sleeve 11 and the number of copy sheets in this first embodiment.

A region where the amount of toner contamination represented by the axis of ordinates of FIG. 5 is lower than N is a region where an influence of the toner contamination does not appear on the image. The amount of toner contamination on the surface of the second developing sleeve 11 must not exceed N irrespective of the number of copy sheets. A line "a" of FIG. 5 represents the amount of toner contamination with respect to the number of copy sheets in the case of not cleaning the above-described toner contamination on the surface of the second developing sleeve 11. In the case of not cleaning the above-described toner contamination on the surface of the second developing sleeve 11, the amount of toner contamination is increased in response to the increase of the number of copy sheets, and exceeds N, which is the upper limit value of the amount of toner contamination.

Figure 6:
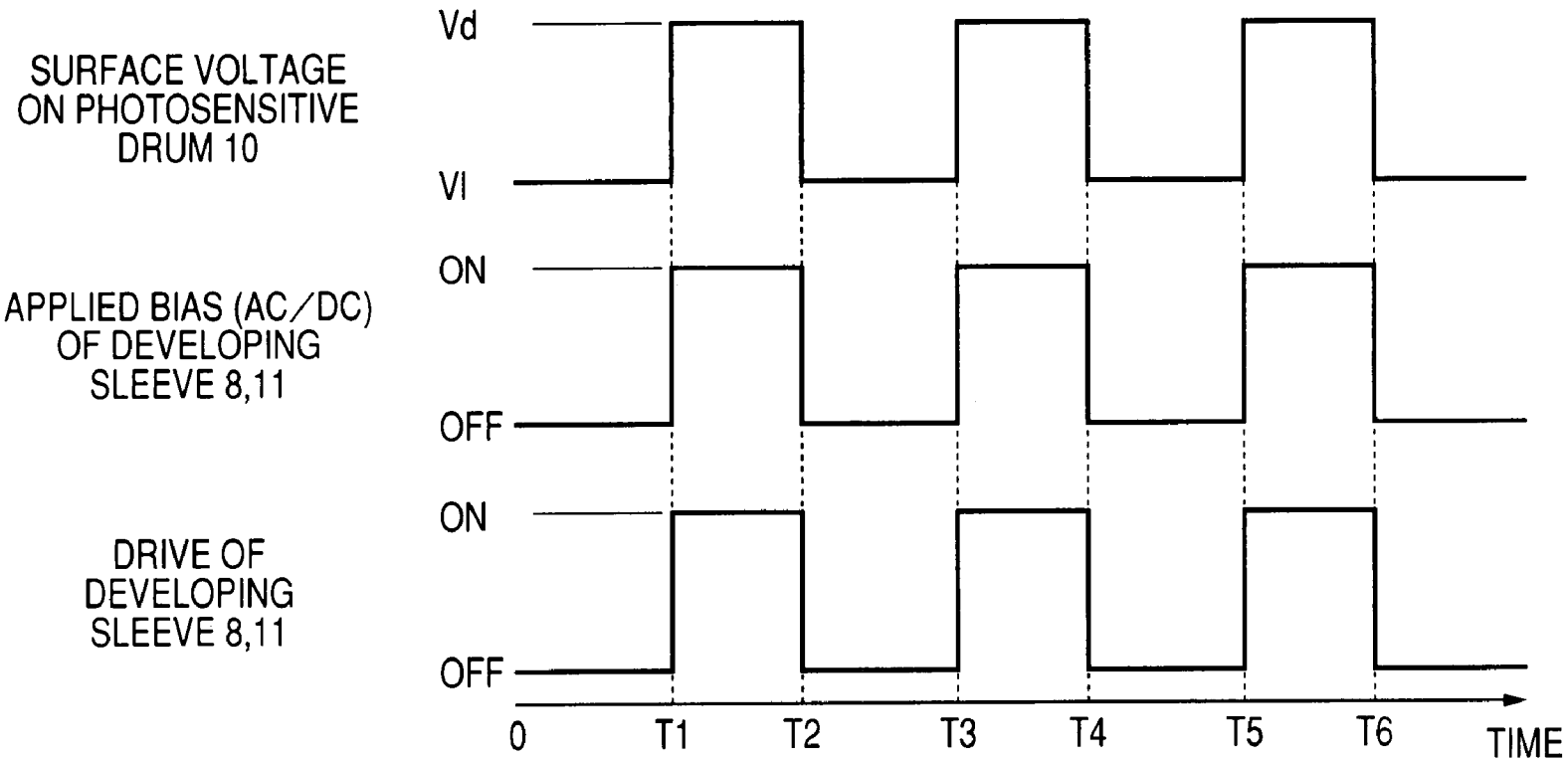
FIG. 6 is an operation timing chart of an embodiment for explaining an operation of the image forming apparatus.

In this connection, the first embodiment of the present invention, which allows the amount of toner contamination not to exceed the upper limit value N, is described in detail based on the timing chart of FIG. 6.

FIG. 6 shows the surface voltage on the photosensitive drum 10 with respect to the time, on/off timing of the applied bias of the first and second developing sleeves 8 and 11, and on/off timing of the drive of the first and second developing sleeves 8 and 11.

In the surface voltage on the photosensitive drum 10 of FIG. 6, an image forming voltage Vl is set at −100 V, and a non-image forming voltage Vd is set at −400 V. The developing bias (AC+DC) is applied to the first and second developing sleeves 8 and 11 when the image forming voltage Vl passes through the above-described developing region, and the development is thus performed.

Figure 7:
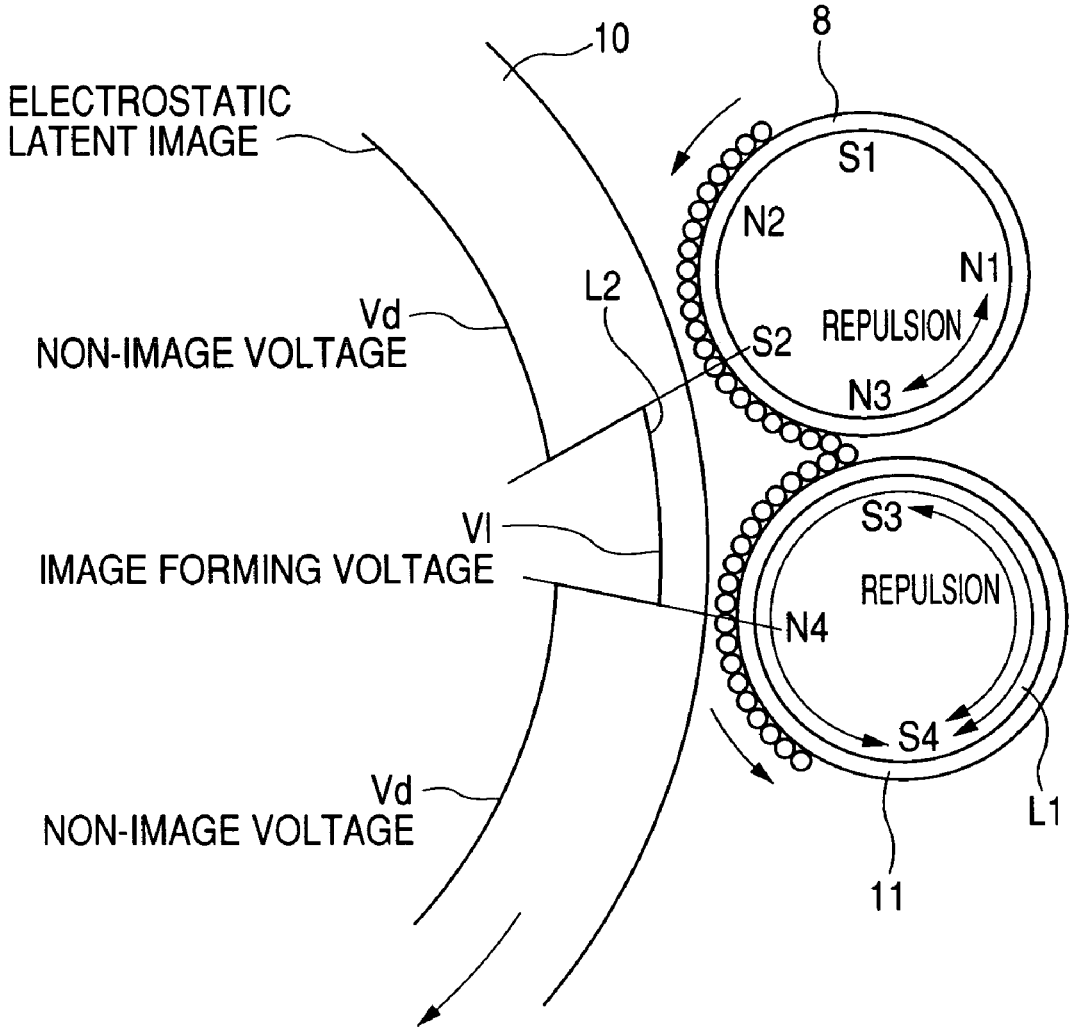
FIG. 7 is a view for explaining a state of a part of the image forming apparatus at a time T1 of the operation timing chart of FIG. 6.

A time T1 of FIG. 6 shows a state shown in FIG. 7. FIG. 7 shows a part of the developing apparatus shown in FIG. 2, and-illustrates the first developing sleeve 8, the second developing sleeve 11, and the photosensitive drum 10. Further, the magnetic pole S2 of the first developing sleeve 8 is set as the developing pole, and the vicinity thereof is set as the developing region of the first developing sleeve 8. In addition, the magnetic pole N4 of the second developing sleeve 11 is set as the developing pole, and the vicinity thereof is set as the developing region of the second developing sleeve 11.

As shown in FIG. 7, the image forming voltage Vl on the surface of photosensitive drum 10 covers a range from the above-described developing region of the first developing sleeve 8 to the above-described developing region of the second developing sleeve 11, and other regions are covered by the non-image voltage Vd. That is, FIG. 7 shows a state where a tip end position of an electrostatic latent voltage on the photosensitive drum 10 passes through the above-described developing region of the second developing sleeve 11.

In the state of FIG. 7 (T1 of FIG. 6), the AC/DC bias is applied to the first and second developing sleeves 8 and 11 to drive the first and second developing sleeves 8 and 11. In such a way, the image forming voltage Vl on the photosensitive drum 10 will be filled with the toner of the second developing sleeve 11 without being substantially filled with the toner of the first developing sleeve 8, thus making it possible to selectively remove the toner contamination on the surface of the second developing sleeve 11.

Figure 8:
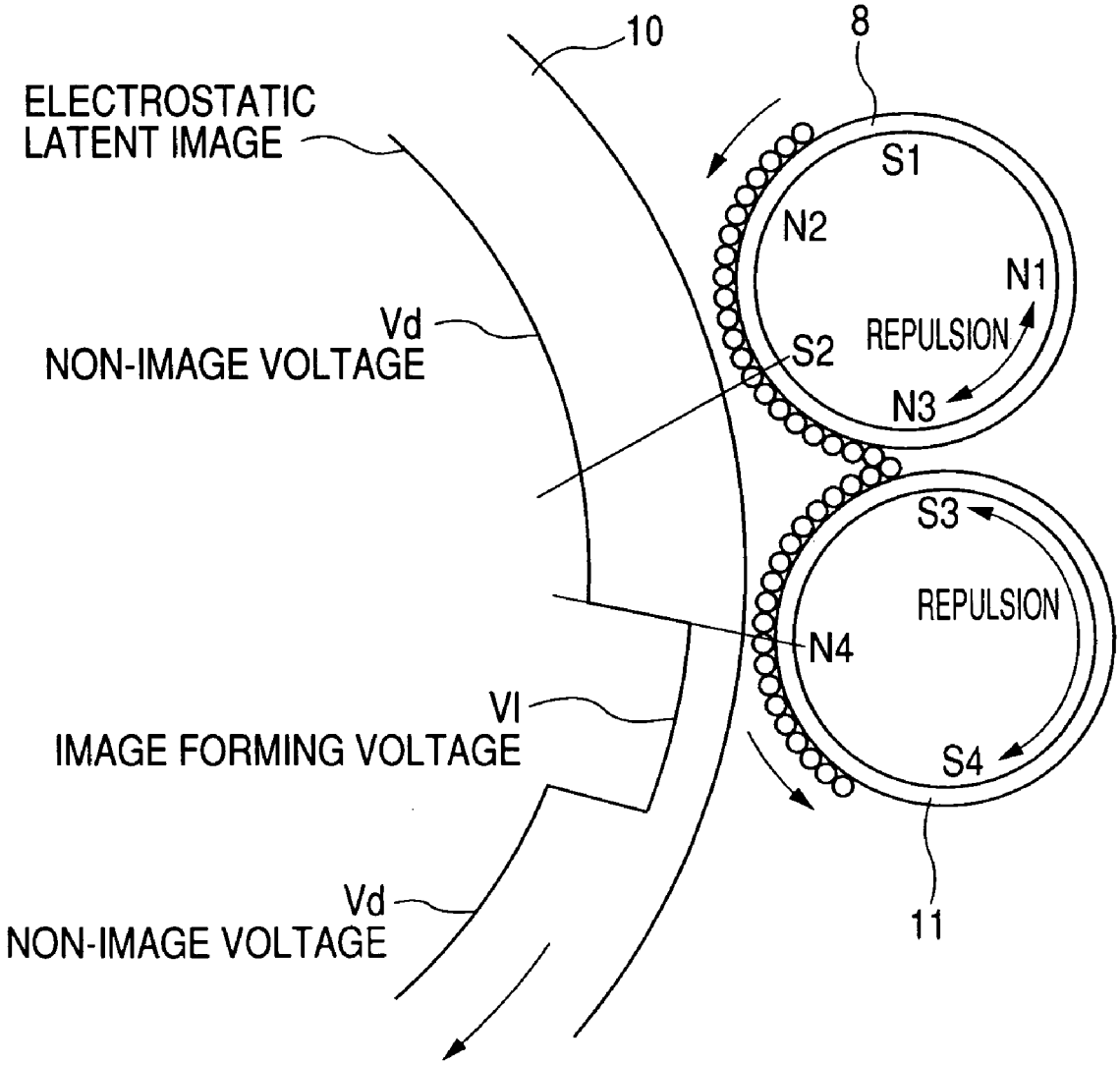
FIG. 8 is a view for explaining a state of a part of the image forming apparatus at a time T2 of the operation timing chart of FIG. 6.

A time T2 of FIG. 6 shows a state of FIG. 8. FIG. 8 shows a state after a rear end position of the image forming voltage Vl on the surface of the photosensitive drum 10 has passed trough the developing region of the second developing sleeve 11, in which other regions are set at the non-image voltage Vd. Specifically, in the state of FIG. 8, it is impossible to discharge the toner on the surface of the second developing sleeve 11 to the photosensitive drum 10. In the state of FIG. 8 (T2 of FIG. 6), the AC/DC bias is not applied to the first and second developing sleeves 8 and 11, and the first and second developing sleeves 8 and 11 are not driven. Accordingly, the toner is not transferred, that is, not discharged from the developing sleeves 8 and 11 to the photosensitive drum 10, thus making it possible to cut down the consumption of the toner.

Specifically, during a period from the time T1 to the time T2 in FIG. 6, the contaminating toner on the surface of the second developing sleeve 11 is discharged, that is, transferred to the photosensitive drum 10 for removal. As a result, the contaminating toner on the surface of the second developing sleeve 11 is thus removed. Here, the time period from the time T1 to the time T2 is one second or less.

Further, times T3 and T5 of FIG. 6 show the state of FIG. 7 in a way similar to the time T1, and times T4 and T6 of FIG. 6 show the state of FIG. 8 in a way similar to the time T2. That is, the contaminating toner is discharged again to the photosensitive drum 10 during a time period from the time T3 to the time T4 and a time period from the time T5 to the time T6.

Specifically, it is also possible to repeatedly perform such a toner discharge mode for removing the contaminating toner until the amount of toner contamination on the surface of the second developing sleeve 11 becomes small.

However, it is self-evident that, if a circumferential diameter L1 of the second developing sleeve 11 shown in FIG. 7 is shorter than a length L2 of the image forming voltage Vl on the surface of the photosensitive drum 10 shown in FIG. 7, it is not necessary to perform the above-described mode for removing the toner plural times since the toner on the surface of the second developing sleeve 11 can be removed entirely by performing the toner discharge mode once.

As shown in the timing chart of FIG. 6, the voltage on the surface of the photosensitive drum 10 and the voltages applied to the first and second developing sleeves 8 and 11 are controlled, and the first and second developing sleeves 8 and 11 are driven, thus making it possible to discharge the toner on the second developing sleeve 11 onto the photosensitive drum 10.

By performing the embodiment with the above-described construction, it is made possible to achieve a line "b" shown in FIG. 5. By performing such processing, the above-described amount of toner contamination does not exceed the upper limit value N thereof irrespective of the number of copy sheets, and the image failure does not occur.

It is recommended to perform the above-described toner discharge mode once per 100 to 500 copy sheets. If it is desired to further restrict the amount of toner contamination of the second developing sleeve 11, it is recommended to perform the toner discharge mode once per 50 copy sheets. However, this is not preferable from a viewpoint of productivity since a down time of the image forming apparatus is increased.

The above-described embodiment is a mere example, and the present invention is not limited to the timing chart shown in FIG. 6. For example, the surface voltage on the photosensitive drum 10 is always maintained at the image forming voltage Vl, and the voltages applied to the first and second developing sleeves 8 and 11 are switched on and off. Also in such a way, the amount of toner contamination can be reduced.

Further, if a construction capable of controlling the voltages applied to the first and second developing sleeves 8 and 11 independently is adopted, and the voltage is not applied to the first developing sleeve 8, the development is not performed by the first developing sleeve 8, and the development is performed only by the second developing sleeve 11. Accordingly, the amount of toner contamination on the surface of the second developing sleeve 11 can be reduced in accordance with various timing charts.

Further, it is also easily conceivable that, if a construction capable of controlling the applied voltages and drives of the first and second developing sleeves 8 and 11 independently is adopted, the amount of toner contamination can be reduced in accordance with various timing charts.

Second Embodiment

Figure 9:
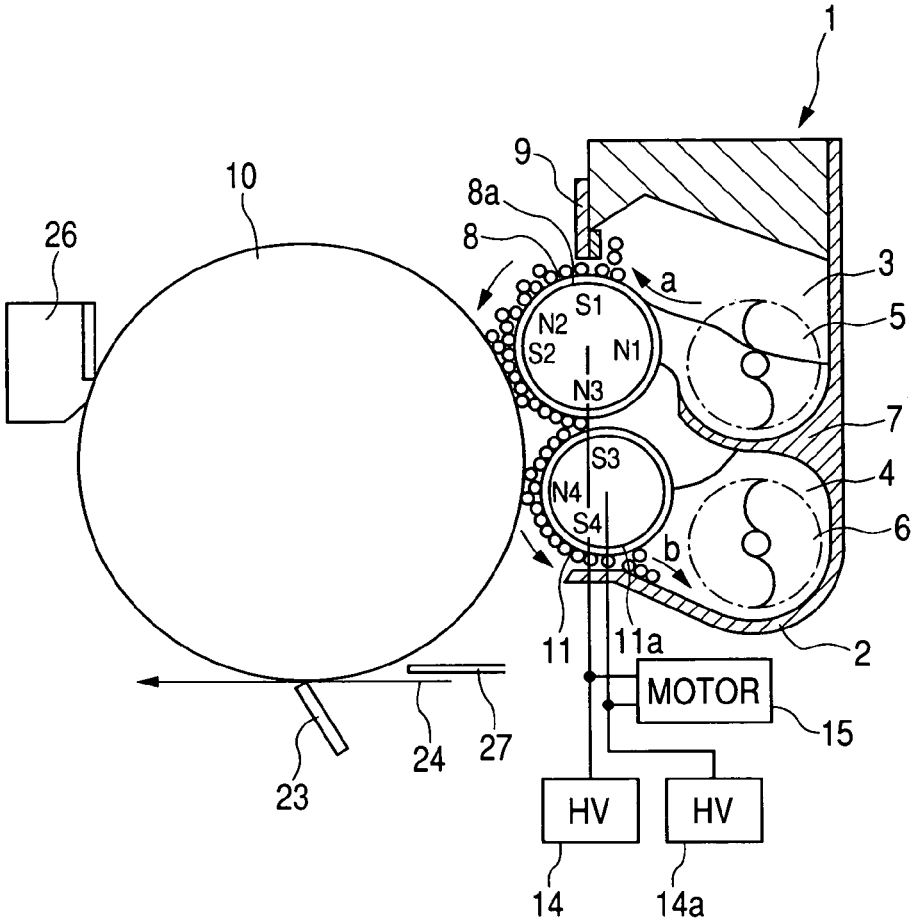
FIG. 9 is a cross-sectional view showing a schematic construction of another embodiment of the developing apparatus for use in the present invention.

A second embodiment of the present invention is described based on FIG. 9.

Although a developing apparatus of this embodiment, which is shown in FIG. 9, has the same construction and arrangement as those of the developing apparatus 1 shown in FIG. 2, the construction is made to be capable of applying the voltage applied to the first developing sleeve 8 by the HV power supply 14 and the voltage applied to the second developing sleeve 11 by an HV power supply 14*a* separately.

Accordingly, in a non-image-formation period, the rotation of the photosensitive drum 10 is stopped, the voltage applied to the first developing sleeve 8 is set at −400 V, and the voltage applied to the second developing sleeve 11 is set at −500 V to form such an electric field that the toner can easily fly (be transferred) from the second developing sleeve 11 to the first developing sleeve 8. Then, the first and second sleeves 8 and 11 are rotated while setting the rotating speed thereof at 10 rps, thus making it possible to transfer the contaminating toner adhering onto the surface of the second developing sleeve 11 to the first developing sleeve 8, and the toner contamination attached onto the surface of the second developing sleeve 11 is removed.

By the above-described embodiment, it is made possible to achieve the line "b" shown in FIG. 5.

By performing this processing the above-described amount of toner contamination does not exceed the upper limit value N irrespective of the number of copy sheets, and the image failure does not occur. It is recommended to perform the processing once per 100 to 500 copy sheets.

Note that the toner transferred to the first developing sleeve 8 is captured by the collected developer in the vicinity of the developer regulating blade 9, causing no problem as mentioned above.

Third Embodiment

Figure 10:
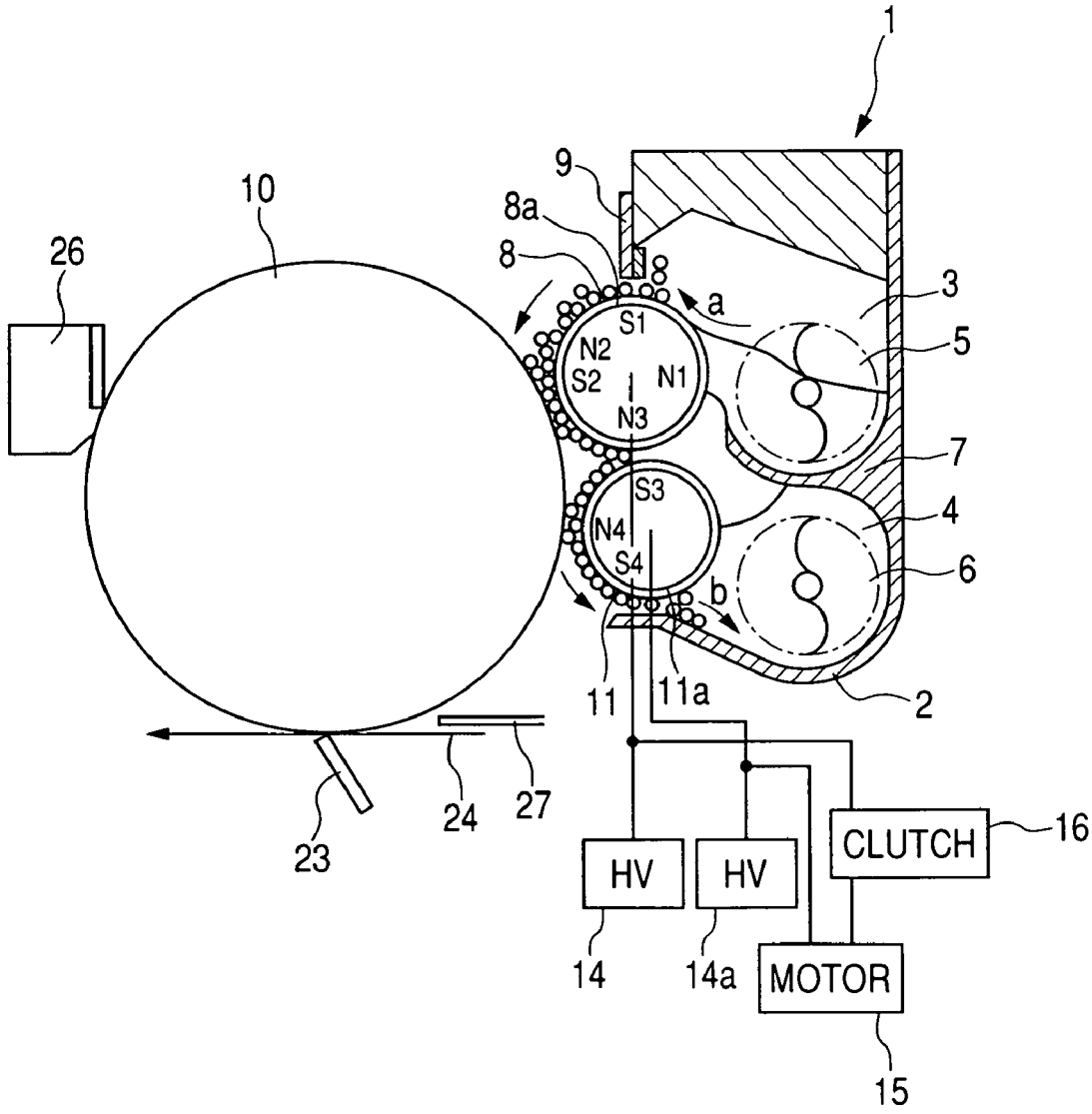
FIG. 10 is a cross-sectional view showing a schematic construction of another embodiment of the developing apparatus for use in the present invention.
Figure 11:
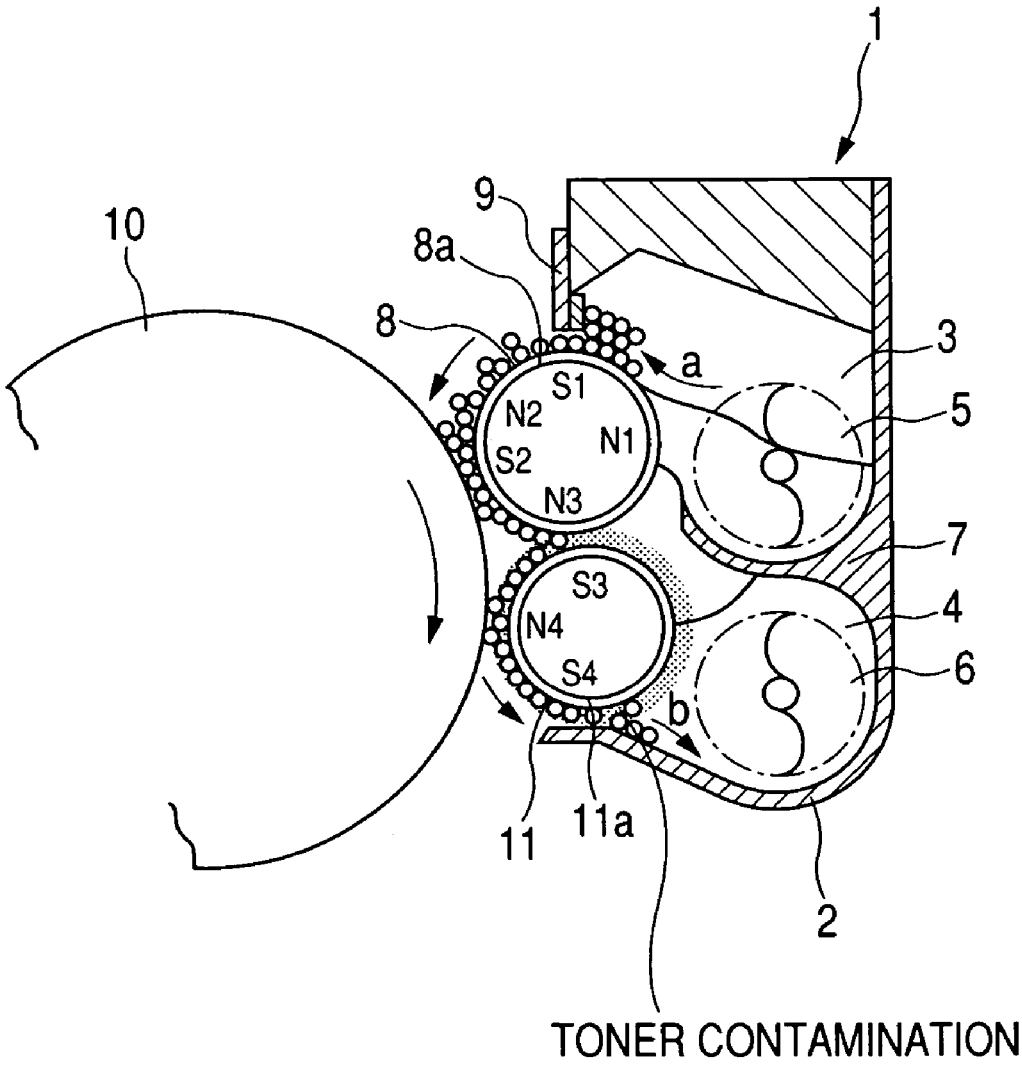
FIG. 11 is a cross-sectional view of a schematic construction for explaining a conventional developing apparatus.

A third embodiment of the present invention is described based on FIG. 10.

A developing apparatus of this embodiment, which is shown in FIG. 10, has the same construction and arrangement as those of the developing apparatus 1 shown in FIG. 9, and has the HV power supplies separately connected to the first and second developing sleeves 8 and 11 in the same way as in the developing apparatus 1 shown in FIG. 9. However, a clutch 16 is provided for the first developing sleeve 8, and is connected to the motor 15. In such a way, a gear ratio is controlled by the clutch 16, and the rotating speed of the first and second developing sleeves 8 and 11 are thus controlled.

With the above-described construction, in this third embodiment, in the non-image-formation period, the rotation of the photosensitive drum 10 is stopped, the voltage applied to the first developing sleeve 8 is set at −400 V, the voltage applied to the second developing sleeve 11 is set at −500 V, to form such an electric field, that the toner can easily be transferred from the second developing sleeve 11 to the first developing sleeve 8. Then, a rotational direction speed of the first developing sleeve 8 is made slower than a rotational direction speed of the second developing sleeve 11, that is, the rotating speed of the first developing sleeve 8 is set at 7 rps, and the rotating speed of the second developing sleeve 11 is set at 10 rps. In such a way, a supply of the developer from the first developing sleeve 8 to the second developing sleeve 11 is reduced more than when the rotating speed of the first developing sleeve 8 is the same as the rotating speed of the second developing sleeve 11. It is thus made possible to rapidly discharge the toner contamination attached onto the surface of the second developing sleeve 11 to the first developing sleeve 8, and the toner contamination attached onto the surface of the second developing sleeve 11 can be removed more rapidly than in the case of the second embodiment.

By the above-described third embodiment, it is made possible to achieve the line "b" in FIG. 5.

By performing this processing, the above-described amount of toner contamination does not exceed the upper limit value N irrespective of the number of copy sheets, and the image failure does not occur. It is recommended to perform above-mentioned processing once per 100 to 500 copy sheets.

Note that the toner transferred to the first developing sleeve 8 is captured by the collected developer in the vicinity of the developer regulating blade 9, causing no problem as mentioned above.

Note that, though the clutch 16 is provided and the motor 15 is shared by the first and second developing sleeves 8 and 11 in the third embodiment, drive sources may be provided separately for the first and second developing sleeves 8 and 11.

As above, the negative toner and the reversal development have been described in the above-described respective embodiments. However, the toner may be either a positive toner or a negative toner, and the developing method may also be either a normal development or a reversal development. Further, in the above-described respective embodiments, description has been made for the case of using one second developing sleeve 11 that is not close to the developer regulating blade; however, even if there are a plurality of second developing sleeves 11 that are not close to the developer regulating blade, it is possible to apply the present invention described above thereto.

As described above, according to the present invention, it is possible to always keep the surface of the developer carrying member that is not close to the developer regulating member in a state free from the toner contamination by cleaning the toner adhering onto the developer carrying member, thus obtaining a toner image in which a developing density is maintained constant.

In particular, the present invention exerts an effect thereof more in the case of using, as the material of the image bearing member, the high dielectric material such as the amorphous silicon and the thin-film OPC with a dielectric constant of 8 or more.

This application claims priority from Japanese Patent Application No. 2004-331265 filed on Nov. 15, 2004, which is hereby incorporated by reference herein.

What is claimed is:

1. An image forming apparatus, comprising:

an image bearing member on which an electrostatic image is formed;

a first developer carrying member and a second developer carrying member, each of which carries a developer for developing the electrostatic image, the developer containing a toner and a magnetic carrier, and each of which feeds the developer to a developing region opposed to the image bearing member; and a developer regulating member, which regulates the developer on the first developer carrying member, wherein the developer is delivered from the first developer carrying member to the second developer carrying member, and wherein the image forming apparatus is provided with a mode for removing the toner on a surface of the second developer carrying member, in which mode, in a non-image-formation period, no toner transfer operation from the first developer carrying member to the image bearing member is substantially performed while a toner transfer operation from the second developer carrying member to the image bearing member is performed.

2. An image forming apparatus according to claim 1, wherein the first developer carrying member is disposed on an upstream side of the second developer carrying member in a moving direction of the image bearing member.

3. An image forming apparatus according to claim 1, wherein in the mode, a potential of the electrostatic image to which the toner is to be transferred, the electrostatic image being formed on the image bearing member, a voltage application to the first developer carrying member and the second developer carrying member, and a drive of the first developer carrying member and the second developer carrying member are controlled, so that the toner on the surface of the second developer carrying member is preferentially removed at a predetermined timing.

4. An image forming apparatus according to claim 1, wherein the toner transfer operation is performed after a leading end of the electrostatic image to which the toner is to be transferred, the electrostatic image being formed on the image bearing member, passes through the developing region of the second developer carrying member.

5. An image forming apparatus according to claim 1, wherein the mode is continuously performed a plurality of times.

6. An image forming apparatus according to claim 1, wherein a voltage application to and a drive of the first developer carrying member and the second developer carrying member are performed using the same high-voltage power supply and drive source.

7. An image forming apparatus according to claim 1, wherein the mode is performed while applying different voltages to the first developer carrying member and the second developer carrying member.

8. An image forming apparatus according to claim 1, wherein the mode is performed while driving the first developer carrying member and the second developer carrying member independently of each other.

9. An image forming apparatus, comprising:

an image bearing member on which an electrostatic image is formed; and a first developer carrying member and a second developer carrying member, each of which carries a developer for developing the electrostatic image, the developer containing a toner and a magnetic carrier, and each of which feeds the developer to a developing region opposed to the image bearing member; and a developer regulating member for regulating the developer on the first developer carrying member, wherein the developer is delivered from the first developer carrying member to the second developer carrying member, and wherein the image forming apparatus is provided with a mode for removing the toner on a surface of the second developer carrying member, in which mode, in a non-image-formation period, a voltage difference between the first developer carrying member and the second developer carrying member is caused, and the toner on the surface of the second developer carrying member is transferred to the first developer carrying member.

10. An image forming apparatus according to claim 9, wherein a rotational direction speed of the first developer carrying member is lower than a rotational direction speed of the second developer carrying member.

11. An image forming apparatus according to claim 1 or 9, further comprising a plurality of image bearing members, wherein the first developer carrying member, the second developer carrying member, and the developer regulating member are provided for each of the plurality of image bearing members, and the mode is performed in the non-image-formation period.

12. An image forming apparatus according to claim 1 or 9, wherein a dielectric material with a dielectric constant of 8 or more is used as the image bearing member.

13. An image forming apparatus according to claim 12, wherein an amorphous silicon material is used as the image bearing member.

* * * * *